US005167073A

United States Patent [19]

Stein

[11] Patent Number: 5,167,073

[45] Date of Patent: Dec. 1, 1992

[54] DOOR FRAME INSTALLATION AND METHOD OF USING

[76] Inventor: Roger P. Stein, 5465 Cooperfield Ct., Lilburn, Ga. 30247

[21] Appl. No.: 725,027

[22] Filed: Jul. 3, 1991

[51] Int. Cl.[5] ..... E04F 21/00; E06B 3/00

[52] U.S. Cl. ..... 33/194; 33/645; 52/127.2; 52/217; 269/905

[58] Field of Search ..... 33/194, 404, 286, 645, 33/562, 667; 269/905, 50; 52/217, 127.2

[56] References Cited

U.S. PATENT DOCUMENTS

| | | | |
|---|---|---|---|
| 937,816 | 10/1909 | Koerner | 33/194 |
| 1,004,471 | 9/1911 | Rose | 33/667 |
| 2,771,688 | 11/1956 | Baker | 33/194 |
| 2,914,813 | 12/1959 | Christian et al. | 52/127.2 |
| 3,168,305 | 2/1965 | Lee | 33/194 |
| 3,199,206 | 8/1965 | Snapp | 33/194 |
| 3,408,744 | 11/1968 | Fitzgerald | 33/194 |
| 4,707,925 | 11/1987 | Englehart | 33/194 |
| 4,829,727 | 5/1989 | Kuzara, Jr. | 52/217 |
| 4,998,355 | 3/1991 | Greene | 33/194 |
| 5,025,607 | 6/1991 | Green et al. | 52/127.2 |

*Primary Examiner*—William A. Cuchlinski, Jr.
*Assistant Examiner*—C. W. Fulton
*Attorney, Agent, or Firm*—Barnes, Kisselle, Raisch, Choate, Whittemore & Hulbert

[57] ABSTRACT

An installation frame to facilitate the mounting of a door frame in a rough opening in a domestic or commerical structure which includes parallel stanchions to be disposed, and secured, one on each side jamb, of the prepared frame. The stanchions with suitable horizontal spacers, are secured inside the jambs and the assembly is placed in the rough opening in a building and clamped in place. A first pair of crossed cables extending from the corners indicates, by included measuring devices, whether the frame is square. A second set of crossed cables extending from the corners indicates, by the closeness of cables at the crossing point, whether the frame is in a single plane and not askew. Adjustments are made to insure squareness and proper plane position and then the prepared jamb is centered in the opening and nailed in place.

6 Claims, 3 Drawing Sheets

DOOR FRAME INSTALLATION AND METHOD OF USING

FIELD OF INVENTION

Installation methods and devices for installing door frames in the construction of domestic and commercial buildings.

BACKGROUND AND FEATURES OF THE PRESENT INVENTION

In the construction of buildings in which doors are to be installed in wall openings, the contractor will provide rough openings according to the specifications in the architectural specifications. The finish carpenters will then install the necessary frames in the rough openings and ultimately hang the doors.

It is essential that the door frames consisting of the side jambs and the lintel be properly installed in order to have a properly fitted door. This means that the door jambs must be plumb, that is, exactly vertical, but the frame must be square and in single plane, that is, not skewed. Usually this is accomplished by accepting an assembled frame from the supplier having the proper dimension and placing it in the rough openings. Wedges are used to locate the side jambs and a level is used to adjust the jambs to plumb positions. Thus, by a manual positioning of various wedges, the frame can be eventually positioned and nailed in place.

However, even a skilled carpenter requires a fair amount of time to install a door frame in a rough opening and to be sure that the frame is square and not skewed.

Previous devices designed to facilitate jamb installation are disclosed in a U.S. Pat. No. 2,771,688 (1956) to Baker and a U.S. Pat. No. 2,914,813 (1959) to Christian and Ryding, Jr.

The present invention is directed to an installation frame which provides a fast and accurate way to install a door jamb and to insure a plumb frame which is not only square but which is in a proper plane and not skewed. The frame of the present invention can be used to increase the speed and accuracy of an installation by a skilled carpenter, but it will also allow less experienced persons to install properly a door frame.

Other objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

BRIEF DESCRIPTION OF THE INVENTION

The invention comprises a frame with vertical stanchions to align with each side jamb separated by spacers. T-screws are provided to secure the stanchions to the side jambs. Measuring tapes anchored to the stanchions are crossed vertically so that exact dimensions from corner to corner insure squareness. Additional cables or cords are stretched from corner to corner of the stanchions and when these cables barely touch centrally, they indicate that the frame is in a proper plane and not skewed.

DETAILED DESCRIPTION OF THE INVENTION AND THE MANNER AND PROCESS OF USING IT

Figure 1:
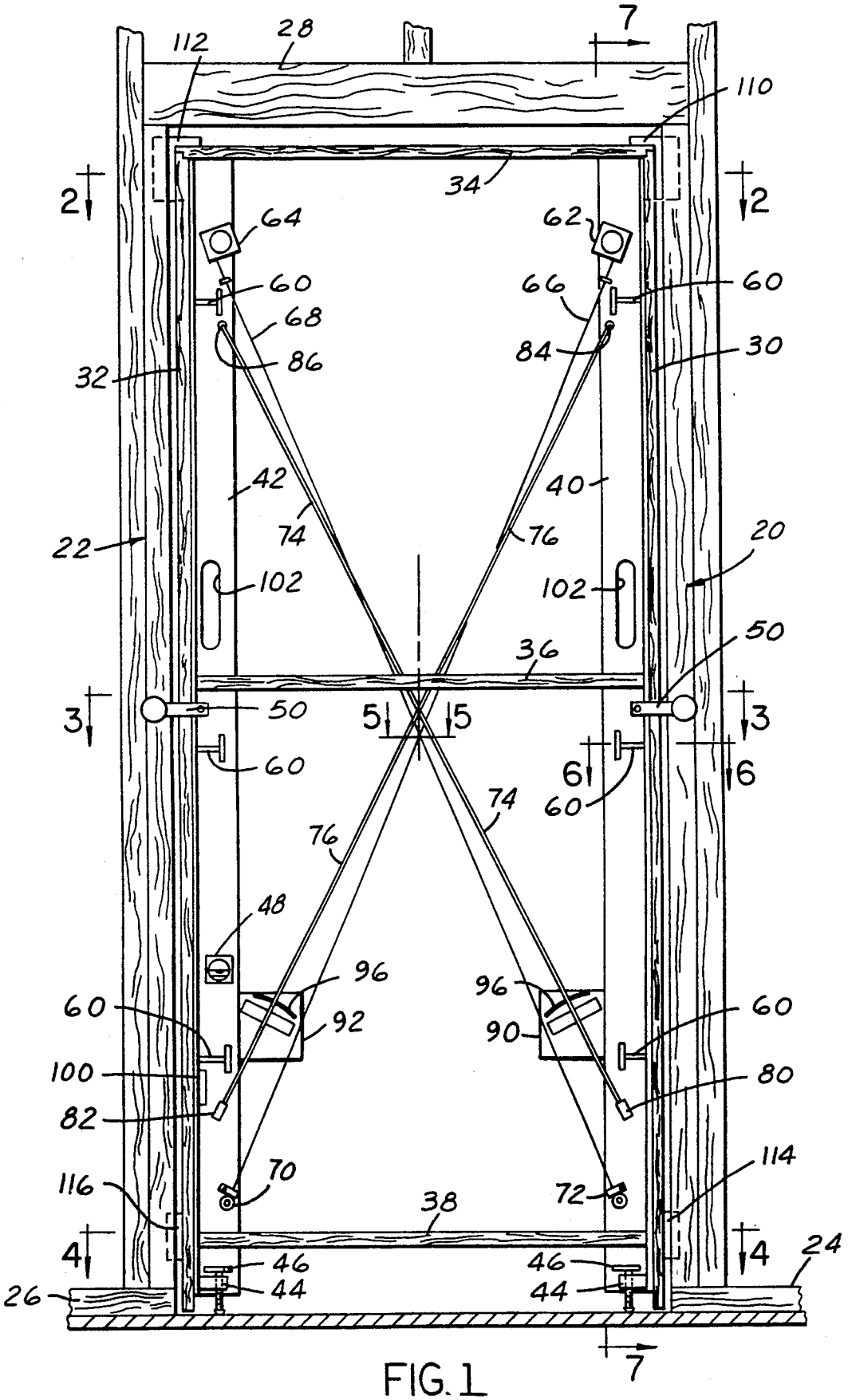
FIG. 1, an upright view of the installation frame as viewed in a rough door opening.

In FIG. 1, an upright view of a rough door opening is illustrated. Double two-by-four uprights 20 and 22 are supported on base plates 24,26, and spanned at the top by a header 28, thus defining the rough opening.

The right and left side jambs 30,32 of a finished door frame are capped by a lintel 34 suitably jointed at the top corners. Two horizontal spacers 36,38 are cut to size and will be placed between the right and left jambs to establish the horizontal dimensions as will be described. This door frame is laid on support horses or other supports to await the installation of the mounting tool.

The mounting tool to be used to establish the proper positioning of the door frame is composed of two elongate L-shaped (in cross-section), left and right stanchions 40 and 42, each with an adjustable foot bracket 44 with a vertical adjustment screw 46. A level unit 48 is mounted on stanchion 42 to establish the plumb position of the unit when upright. Swivel clamps 50 on each side stanchion are provided to anchor the side jambs to the sides of the rough opening.

A plurality of T-screws 60 are mounted on the stanchions to locate and secure the stanchions to the side jambs of the frame members 30,32. Two spring recoil reels 62 and 64 are mounted respectively on the stanchions 40,42 at the top, each connected respectively to a cross-line 66 and 68 which connect diagonally at a lower end with an opposite stanchion at 70 and 72 respectively.

Diagonal measuring tapes 74,76 are also provided, anchored at the bottom of the stanchions at 80,82 and extending diagonally to anchoring points 84 and 86 at the top of the stanchions. These tapes each cross a vertical plate 90,92 respectively which carries an arcuate scribed line 96. A second level 100 indicates if the wall, in which the rough opening is formed, is plumb. Elongate slots 102 are hand slots to facilitate the handling of the stanchions.

At the top corners of the stanchions, as viewed in FIG. 1, are flat tabs 110,112 dimensioned to extend to the vertical two-by-fours 20,22 to retain the stanchions in the rough opening prior to proper alignment. At the lower end are side tabs 114,116 for the same purpose.

While the door jambs 30,32 connected to the lintel 34 are lying on spaced supports, two spacers 36 and 38, previously referenced, are cut to the inside jamb dimensions minus ½" to allow for the thickness of the side pieces of the stanchions. The stanchions 40,42 are now placed on the inside of each side of the prepared frame and screwed to the jambs with the top end of the stanchions tight against the lintel 34. The assembly with the jambs 30,32 and the stanchions 40,42 is now lifted and placed vertically into the rough opening between two-by-fours 20,22. This placement is done from the hinge side of the opening. The side tabs 110,112,114,116 locate the assembly in the rough opening and the side clamps 50 are swung around to contact the sides of the rough opening as shown in FIG. 1. The spacers 36,38, previously cut to size, are put in place at the middle and bottom of the opening, also as shown in FIG. 1.

Figure 5:
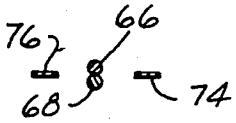
FIG. 5, a section on line 5—5 of FIG. 1.
Figure 6:
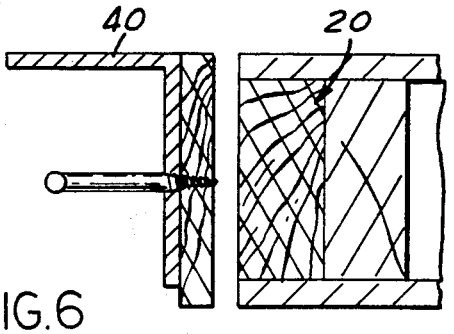
FIG. 6, a section showing the T-screw fastening of a door jamb to the tool.

At this stage, the side levels 48 and 100 are consulted to determine whether the wall is plumb and the door jambs properly placed vertically. The cross-lines 66,68 are now reeled out and attached at the anchoring points 70,72. If these lines barely touch (FIG. 5), this is an indication that the frame opening is in vertical plane and not skewed. If the lines do not touch, adjustments must be made until they do touch.

Figure 2:
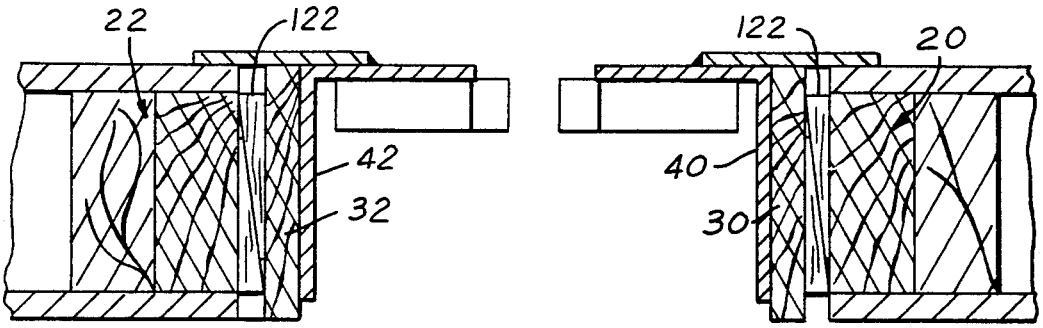
FIG. 2, a section on line 2—2 of FIG. 1.
Figure 3:
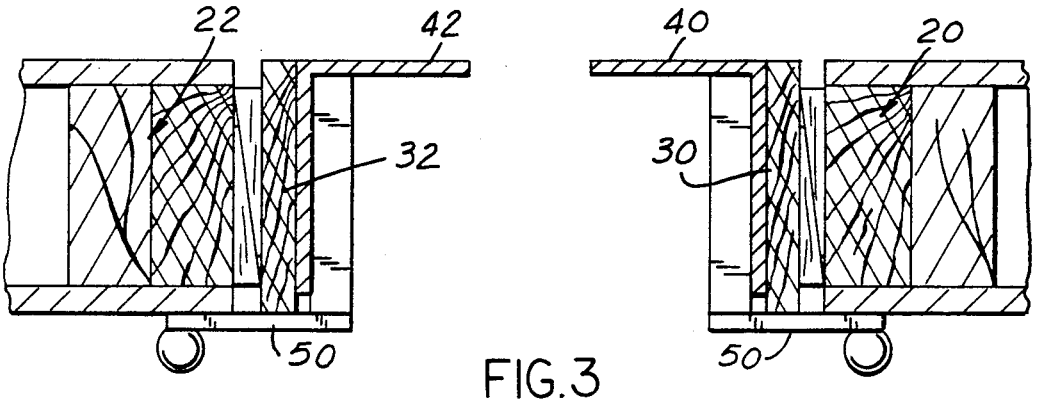
FIG. 3, a section on line 3—3 of FIG. 1.
Figure 4:
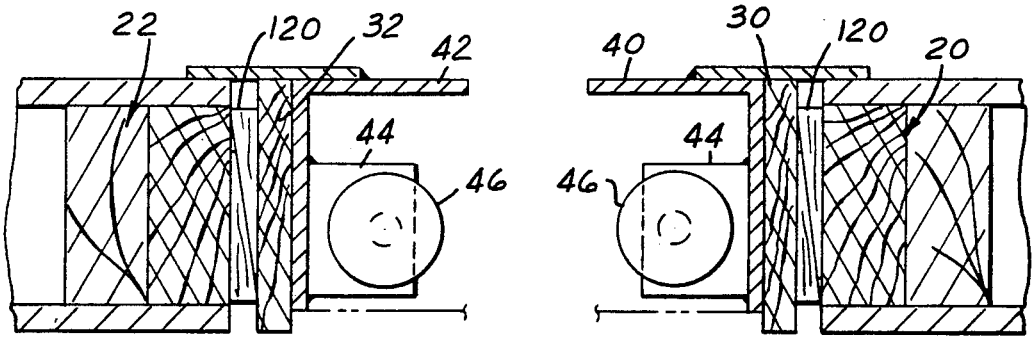
FIG. 4, a section on line 4—4 of FIG. 1.

Shingle wedges 120 can now be placed (FIG. 4) at the bottom of the assembled frame to center the jamb in the rough opening. Next shingle wedges 122 are placed (FIG. 2) at the top of the assembly to plumb the assembly in the opening by reading the levels 48 and 100. The measuring tapes 80,82 are now unreeled to be anchored at the top of the stanchions at 84 and 86 respectively. If both tapes read exactly the same on the scribed lines 96, this is an indication that the jamb opening is square. If the reading is not identical, the bottom adjusting screws 46 can be used to raise or lower the respective sides to reach an exact reading on each side.

Figure 7:
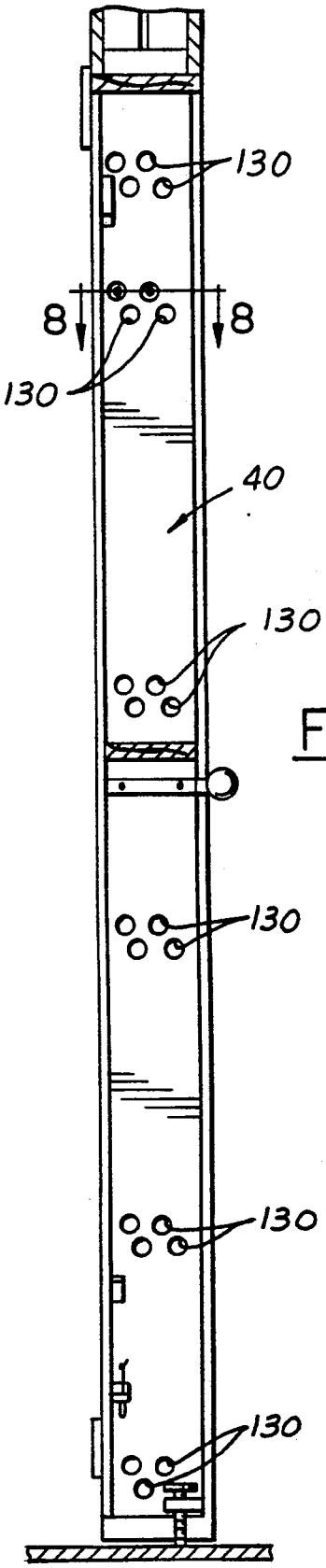
FIG. 7, an upright view of a side stanchion showing the hole pattern used for nailing the jamb in the rough opening to avoid location of hinges and a striker plate.
Figure 8:
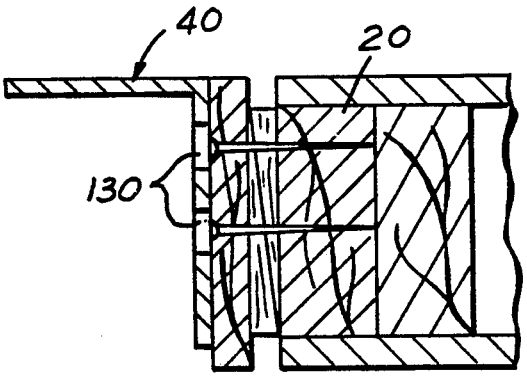
FIG. 8, a sectional view on line 8—8 of FIG. 7.

At this point with the cross-lines 66,68 touching and the tapes 74,76 reading the same at the scribe lines 96, the remaining wedge shingles can be installed, and the clamps tightened preparatory to nailing the jamb in place. As shown in FIGS. 7 and 8, nail openings 130 in the side stanchions 40,42 are provided to permit the driving of nails into the sides of the rough opening prior to the removal of the stanchions. These nail openings are positioned to avoid the placing of nails where hinges and a striker plate are to be mounted.

The stanchions can be made of lightweight magnesium so that the assembly is relatively light in weight and easily handled by a single workman.

What is claimed is:

1. A method of installing finish door frames in rough openings in the construction of dwellings and commercial structures which comprises:

(a) selecting a finish frame with side jambs and a connecting lintel, (b) placing and securing a side stanchion inside each side jamb, (c) placing the assembly of said frame and said stanchions in a rough door opening, (d) placing spacers between said stanchions to establish a predetermined width of a finished door opening, (e) utilizing a level to establish the plumb of said assembly, (f) providing one pair of cross-lines diagonally across said assembly from opposite corners to determine the plane of the frame and absence of skewing, (g) providing a second pair of cross-tapes extending diagonally across said assembly from predetermined location to measure squareness of the frame by equal reading of the tapes, and (h) securing the finish frame centrally in the rough opening with other spacer pieces between the outside of the side jambs and the insides of the rough opening.

2. A tool to assist in the installation of a finish door frame in the rough opening of a dwelling or a commercial structure which comprises:

(a) a pair of right and left elongate stanchions, (b) means on said stanchions to attach to a side jamb plate of a finish jamb frame formed of side jambs and a connecting lintel, (c) a first pair of diagonal lines each extendible from a top corner of a first stanchion on one side of said frame to a lower corner of a second stanchion on another side of said frame to indicate planar accuracy of said frame, (d) a second pair of diagonal tapes mounted respectively on said stanchions extendible diagonally from one set of corners of spaced stancions to a second set of corners to measure the diagonal distances and indicate squareness of a door frame to be attached to a rough opening, and bottom adjustments on each said stanchion to allow vertical adjustment to squareness, and (e) plate extension on said right and left stanchions extended inwardly positioned to be crossed by said tapes, each having scribe lines to indicate relative angle positions on said tapes ot insure squareness.

3. A tool to assist in the installation of a finish door frame in the rough opening of a dwelling or a commercial structure as defined in claim 2 in which a plurality of lateral, flat plate extensions are mounted on each end of a stanchion to locate the stanchions in a rough door opening.

4. A tool to assist in the installation of a finish door frame in the rough opening of a dwelling or a commercial structure as defined in claim 2 in which said stanchions are L-shaped in cross-section having one leg fastenable to an upright jamb plate and a second leg normal to said first leg extending into the plane of a door opening.

5. A tool to assist in the installation of a finish door frame in the rough opening of a dwelling or a commercial structure as defined in claim 2 in which said means comprises a plurality of screws on each stanchion projectible into a side jamb of a frame to be mounted.

6. A tool to assit in the installation of a finish door frame in the rough opening of a dwelling or a commercial structure which comprises:

(a) a pair of right and left elongate stanchions, (b) means on said stanchions to attach respectively to a side jamb plate of a finish jamb frame formed of side jambs and a connection lintel, (c) a first pair of diagonal lines each extendible from a top corner of one stanchion on one side of said frame to a lower corner of an opposite stanchion on the other side of said frame, to indicate, when touching at the cross point, that the frame is in a plane and not skewed, (d) a second pair of diagonal measuring tapes mounted respectively on said stanchions, each extendible diagonally from a top corner of one stanchion oln one side of said frame to a lower corner of an opposite stanchion to the other side of said frame, (e) means on each stanchion crossed respectively by said diagonal measuring tapes and providing opposed and fixed read lines for said tapes to allow equalization of the reading on said tapes, and (f) adjusting means on each side stanchion to permit vertical adjustment to squareness as determined by the reading on said second pair of diagonal tapes at said read lines.

* * * * *